US007989726B2

(12) United States Patent
Lindner et al.

(10) Patent No.: US 7,989,726 B2
(45) Date of Patent: Aug. 2, 2011

(54) ELECTRICAL DEVICE CONTAINING INSULATING GAS UNDER PRESSURE AND INCLUDING A COMPOSITE INSULATOR PROVIDED WITH A WINDOW FOR OBSERVING CONTACTS

(75) Inventors: Christian Lindner, St. Cyr au Mont d'Or (FR); Jean-Luc Bessede, Chateauvilain (FR); Yannick Kieffel, Frontonas (FR)

(73) Assignee: Areva T & D SA, Paris la Defense (FR)

( * ) Notice: Subject to any disclaimer, the term of this patent is extended or adjusted under 35 U.S.C. 154(b) by 677 days.

(21) Appl. No.: 11/547,456

(22) PCT Filed: Apr. 7, 2005

(86) PCT No.: PCT/FR2005/050213

§ 371 (c)(1),
(2), (4) Date: Jul. 30, 2007

(87) PCT Pub. No.: WO2005/101438

PCT Pub. Date: Oct. 27, 2005

(65) Prior Publication Data

US 2007/0295694 A1 Dec. 27, 2007

(30) Foreign Application Priority Data

Apr. 7, 2004 (FR) ..... 04 50697

(51) Int. Cl.
*H01H 33/02* (2006.01)

(52) U.S. Cl. ..... 218/156; 218/78; 218/154

(58) Field of Classification Search ..... 218/2–7, 218/10–14, 58, 75, 78, 89, 90, 118–120, 218/139, 140, 152–155
See application file for complete search history.

(56) References Cited

U.S. PATENT DOCUMENTS

| | | | | |
|---|---|---|---|---|
| 4,249,050 | A | 2/1981 | Okumura et al. | |
| 4,384,185 | A | 5/1983 | Hall et al. | |
| 4,910,367 | A | 3/1990 | Akers et al. | |
| 4,935,590 | A * | 6/1990 | Malkin et al. | 218/57 |
| 2008/0296046 | A1 * | 12/2008 | Bessede et al. | 174/139 |

FOREIGN PATENT DOCUMENTS

| | | |
|---|---|---|
| AU | 738593 | 9/2001 |
| DE | 34 12 250 A1 | 10/1985 |
| DE | 44 35 358 A1 | 3/1996 |
| EP | 0 932 177 A | 7/1999 |
| FR | 2355 364 | 1/1978 |
| GB | 1 253 604 A | 11/1971 |

* cited by examiner

*Primary Examiner* — Renee Luebke
*Assistant Examiner* — Marina Fishman
(74) *Attorney, Agent, or Firm* — Nixon Peabody LLP

(57) ABSTRACT

The gas-tight, high or medium voltage electric switch device (1), containing an insulating gas under pressure, comprises switch contacts (2) capable of occupying an open position and a closed position and disposed inside a composite insulator formed by a rigid tube (3) surrounded by an elastomer casing (4) whose outside surface defines a succession of annular fins. The rigid tube and the elastomer casing are arranged so as to define an observation window (7) that is at least translucent, and through which the open or closed position of the switch contacts is visible.

5 Claims, 4 Drawing Sheets

ELECTRICAL DEVICE CONTAINING INSULATING GAS UNDER PRESSURE AND INCLUDING A COMPOSITE INSULATOR PROVIDED WITH A WINDOW FOR OBSERVING CONTACTS

CROSS-REFERENCE TO RELATED APPLICATION

This application claims priority based on International Patent Application No. PCT/FR2005/050213 filed on Apr. 7, 2005, entitled "An Electrical Device Containing Insulating Gas Under Pressure and Including a Composite Insulator Provided with a Window for Observing Contacts" by Christian Lindner, Jean-Luc Bessede and Yannick Kieffel, which claims priority of French Application No. 04 50697, filed on Apr. 7, 2004, and which was not published in English.

TECHNICAL FIELD

The present invention relates to a gas-tight, high or medium voltage, electric switch device containing insulating gas under pressure, and comprising an enclosure containing switch contacts capable of occupying an open position and a closed position, together with a system for identifying the open or closed position of the switch contacts from outside the enclosure.

STATE OF THE PRIOR ART

Patent document DE-195 19 721 discloses a circuit breaker of the above-specified type in which the enclosure is constituted by a metal casing filled with a dielectric insulating gas such as $SF_6$ under a pressure of a few bars, and the system for identifying the position of the switch contacts is constituted by an optical barrier located inside the spacing between the fixed contact and the moving contact, and by optical fibers which deliver an optical signal to the outside of the enclosure to indicate the position of the switch contacts.

U.S. Pat. No. 4,249,050 discloses a vacuum switch, or vacuum "bottle", including a viewing window in order to see the position of the contacts directly.

Patent GB 1 253 604 discloses the use of a thermoplastic polymer window for viewing. That document describes making a transparent window out of a thermoplastic material in an opening of a casing for an electrical device. The window is inserted in the opening by a method of injection-molding a plastics material, the edge of the opening and the edge of the window being anchored one in the other.

SUMMARY OF THE INVENTION

The object of the invention is to propose a high or medium voltage electric switch device, containing an insulating gas under pressure, and for outdoor use, which device is of a design that is simpler and of increased reliability, while making it possible to view directly the position of the switch contacts. In such an application, it is necessary to be rigorous in selecting the materials used in order to take account of the combined stresses applied to the device. Unlike U.S. Pat. No. 4,249,050, the invention provides a device that is under pressure, presenting internal pressure that is greater than atmospheric pressure, thus leading to an outwardly-directed compression force. Similarly, unlike patent GB 1 253 604, the invention seeks to insert a viewing window in an electrical switch device. The material must be capable of withstanding internal attack from the decomposition products of the integrating gas, and external attack from the surroundings, i.e. from the combination of rain, ultraviolet radiation, salt mist, and physical and chemical aging. Similarly, the materials must satisfy the electrical criteria that are essential for such applications in the field of medium and high voltages, in particular good ability to withstand electrical creepage and erosion. In addition, the materials used for making the viewing window, and the methods used for implementing the junction between the window and the body of the insulator must make it possible to ensure that the device is gas-tight. The acceptable annual level of insulating gas loss from the device as a whole is less than or equal to 1%. Together, these selection criteria put a restriction on the choice of materials that are available for performing the function. Thus, the criteria for selecting materials are clearly set out in the invention to enable a high or medium voltage electric switch device containing insulating gas under pressure to be provided that comprises in an enclosure, switch contacts capable of occupying an open position and a closed position, and a system for identifying the open or closed position of the switch contacts from outside the enclosure.

To this end, the invention provides a gas-tight, high or medium voltage electric switch device comprising an enclosure containing switch contacts capable of occupying an open position and a closed position, and a system for identifying the open or closed position of the switch contacts from outside the enclosure, the enclosure being a composite insulator formed by a rigid tube surrounded by an elastomer casing whose outside surface defines a succession of annular fins, the device being characterized:

in that the rigid tube and the elastomer casing are arranged to define an observation window that is at least translucent and through which the open or closed position of the switch contacts is visible;

in that the rigid tube is made of a translucent composite material or of a plastics material that is at least translucent, and in which a transparent porthole of a material that filters ultraviolet radiation, or on which a transparent ultraviolet filter is deposited, is stuck onto the rigid tube, said porthole not being covered by the casing of elastomer, and defining the observation window, the rigid tube being formed by an assembly of tubes, one of the tubes being made of glass or of a polymer that is at least translucent and that withstands ultraviolet radiation;

in that all of the materials in contact with solar radiation withstand ultraviolet radiation; and in that the dielectric gas is at a pressure of 2 bars to 3 bars.

Together, the materials used, make it possible to ensure: gas-tightness, the electrical installation function, and the ability to withstand attacks from inside and outside the electrical device as made in this way.

Advantageously, the materials that come into contact with solar radiation should not present signs of degradation, such as cracking, surface deformation (increase in surface roughness), or loss of transparency after accelerated aging for 1000 hours under UV radiation from a xenon arc source or under UV fluorescent lamps, in application of the ISO 4892-2 and ISO 4892-3 standards. In other words, the polymers constituting the outer enclosure or the porthole and that come into direct contact with solar radiation must advantageously be selected from polymers that do not present radiation absorption in the wavelength range extending from 300 nanometers (nm) to 400 nm, i.e. the chemical structure of these polymers must not contain any aromatic cycle.

An electric switch device of the invention may present the following features:

- the rigid tube is made of a plastics material that is at least translucent, and the casing has a segment surrounding the switch contacts that is made of an elastomer material that is at least translucent;
- the translucent segment of the casing is made by injection molding a first elastomer material and is interposed between two end segments of the casing which are made by injection molding a second elastomer material having a greater fill of mineral fillers than the first elastomer material.

In another embodiment of the invention, the rigid tube is made of glass, and a zone of the rigid tube is not covered by the elastomer casing, said zone defining said observation window.

In another embodiment of the invention, the rigid tube is made of a translucent composite material or of a plastics material that is at least translucent, and a transparent porthole of a material that filters ultraviolet radiation is stuck onto the wall of the rigid tube, said porthole not being covered by the casing of elastomer, and defining the observation window.

In another embodiment of the invention, the rigid tube is formed by an assembly of tubes, one of the tubes being made of glass or of a polymer that withstands ultraviolet radiation and not being covered by the casing of elastomer, thereby defining the observation window.

A device of the invention may also present the following features:

- the at least translucent plastics material is polymethyl methacrylate (PMMA), polycarbonate (PC), crystal polystyrene (PS), polyvinylidene fluoride (PVDF), or cycloaliphatic epoxy resin;
- the elastomer material is silicone, ethylene proplene rubber, or fluorinated elastomer, possibly filled with mineral fillers. Particular mention can be made of a filler of the alumina trihydrate type (ATH) which improves the ability of the casing to withstand creepage;
- the rigid tube contains a dielectric insulating gas;
- the rigid tube is protected on the inside by a deposit of transparent material that is chemically inert against attack by the products of $SF_6$ decomposing, e.g. by a deposit of polytetrafluoroethylene or of other fluorinated polymers;
- the rigid tube in direct contact with the atmosphere is made of a material that withstands solar radiation (in particular ultraviolet radiation), or else it is made of a material that does not withstand ultraviolet radiation, but that is protected by an anti-UV filter; and
- amongst the transparent materials mentioned in the invention for making the rigid tube or the porthole, polycarbonate based on a bisphenol motif and polystyrene containing aromatic cycles must absolutely be protected from UV by using an anti-UV filter or by adding an ultraviolent absorber. Polymethylmethacrylate (PMMA), polyvinylidene fluoride (PVDF), and cycloaliphatic epoxy resin can be used directly in contact with the atmosphere.

In the invention, the electric switch device may be a high or medium voltage line disconnector in which the tube is filled with a dielectric insulating gas such as $SF_6$ under a pressure of 2 to 3 bars. In this application, the switch contacts are opened while they are not live so that the transparent plastics material tube is not subjected to high temperatures due to the presence of electric arcing. In addition, the insulating gas is not ionized by electric discharges and remains inert relative to the transparent plastics material of the tube.

BRIEF DESCRIPTION OF THE DRAWINGS

An embodiment of an electric switch device of the invention is described below and is shown in the accompanying drawings.

DETAILED DESCRIPTION OF PARTICULAR EMBODIMENTS

Figure 1:
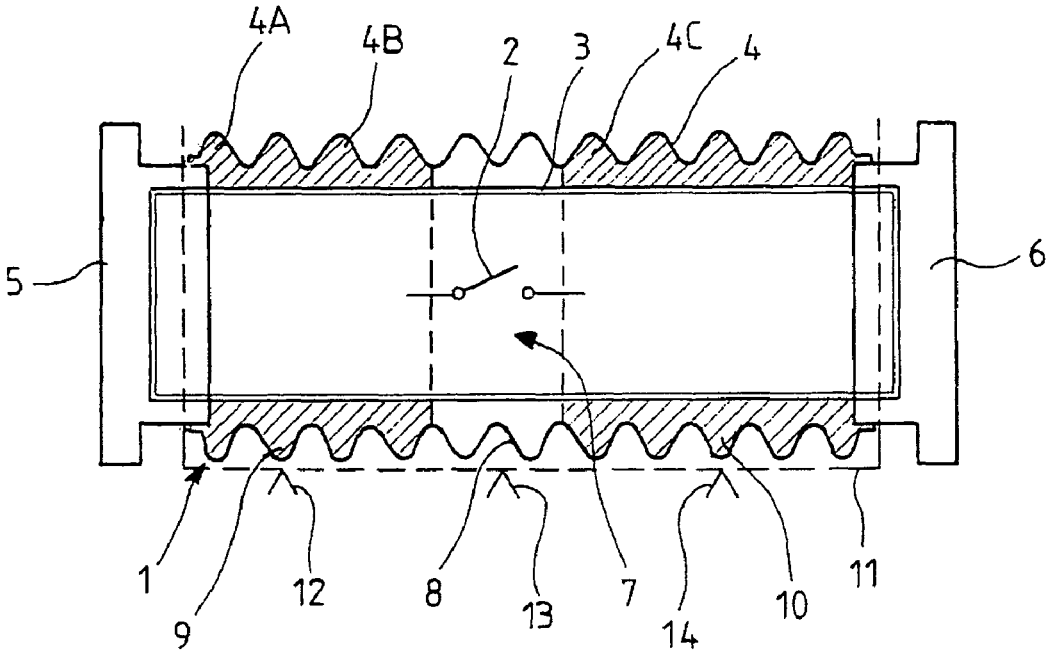
FIG. 1 is a highly diagrammatic view of an electric switch device of the invention.

In FIG. 1, a high or medium voltage electric switch device 1 of the invention comprises switch contacts 2 capable of occupying an open position and a closed position, and disposed inside a composite insulator formed by a rigid tube 3 surrounded by an elastomer casing 4.

Inside the tube, the switch contacts 2 comprise a fixed contact assembly and a moving contact assembly. The moving contact assembly is disposed in the zone halfway along the tube as shown in FIG. 1. When the switch contacts are in the open position, it should be understood that the moving contact assembly is in a position such that it is not electrically connected to the fixed contact assembly.

As can be seen in FIG. 1, the elastomer casing has an outside surface which defines a succession of annular fins such as 4A, 4B, 4C that share a common axis and that are distributed along the tube 3 between two metal end fittings 5 and 6 of the composite insulator in which the two ends of the tube 3 are fixed respectively.

Although in FIG. 1 the tube 3 shown is cylindrical in shape, the invention extends to a tube having some other circularly symmetrical shape, for example a truncated cone shape or indeed a barrel shape.

In the invention, the rigid tube 3 and the elastomer casing 4 are arranged to define an observation window 7 that is at least translucent, and through which the open or closed position of the switch contacts 2 can be seen (in this case they are in the open position).

More particularly, the rigid tube 3 is made by molding a plastics material that is transparent or at least translucent, that withstands ultraviolet radiation, that withstands explosion, and that presents good chemical behavior. By way of example, the plastics material may be a thermosetting polymer such as cycloaliphatic epoxy resin cured by a non-aromatic phthalic anhydride of the hexahydrophthalic (HHPA) type, or a transparent thermoplastic polymer such as safety glass made of polymethyl methacrylate (PMMA) known under the name "Altuglas" from the supplier "Atoglas", a polycarbonate known under the name "Makrolon" from the supplier "Bayer MaterialScience", a polystyrene, or indeed a polyvinylidene fluoride (PVDF).

Such a rigid tube 3 having wall thickness of about 8 millimeters (mm) can be filled with a dielectric insulating gas, in particular $SF_6$, at a pressure of about 2 bars to 3 bars. The rigid tube 3 may optionally be protected on the inside against being attacked by the products of $SF_6$ decomposing, by depositing a chemically inert transparent material. Such protection may be implemented, by way of example, by means of a very thin layer (a few micrometers thick) deposited under a vacuum (e.g. by chemical vapor deposition (CVD), or by sputtering, . . . ) or by a thicker layer of polytetrafluoroethylene (PTFE) or of some other fluorinated polymer such as perfluoroalcoxy resin (PFA) or fluorinated ethylene propylene (FEP). The tube may be protected from aggression such as ultraviolet radiation by adding a UV filter based on incorporating an ultraviolent absorber of aromatic structure, for example from the benzaldehyde family. Similarly, it is possible to use a transparent ultraviolet filter of the "Altuglas CN" type sold by the supplier Altuglas.

The assembly constituted by the rigid tube, the porthole, and the anti-UV filter must withstand UV, so that this assembly does not present signs of degradation, such as cracking, surface deformation (increase in surface roughness), or loss of transparency after accelerated aging for 1000 hours under UV radiation from a xenon arc source or under UV fluorescent lamps, in application of the ISO 4892-2 and ISO 4892-3 standards.

Furthermore, an annular segment 8 of the casing surrounding the switch contacts 2 is made of an elastomer material that is at least translucent and that defines the observation window 7. This annular segment is a segment of the casing that is disposed substantially in the zone halfway along the tube (a middle zone containing the moving contact assembly) so as to be interposed between two other segments 9, 10 at the ends of the casing.

The elastomer constituting the casing must have good mechanical, transparency, and aging properties, and it must be capable of withstanding ultraviolet radiation and abrasion by electric arcing. More particularly, the elastomer must present strength against tearing greater than 6 newtons per millimeter (N/mm). The elastomer must withstand physico-chemical aging and attack from water. The dielectric loss factor (tan δ) of the elastomer must remain below 0.2 after being immersed for 50 days in water at 50° C. For UV resistance, the elastomer must not present signs of degradation, such as cracking, surface deformation (increasing surface roughness), or loss of transparency after accelerated aging for 1000 hours under UV radiation from a xenon arc source or under UV fluorescent lamps, in application of the ISO 4892-2 and ISO 4892-3 standards.

Concerning the ability of the elastomer to withstand creepage and erosion, the material must at a minimum be of class 1A3.5 as defined by method 1 (criterion A) of IEC standard 60587.

The elastomers mentioned in the invention for making the enclosure of the electrical device do not have any chemical structure of aromatic type. They therefore present good intrinsic resistance to UV. Adding a UV filter or a UV absorber is therefore pointless.

In FIG. 1, shaded lines show the two end segments 9 and 10 which are made by injection molding a first elastomer material, e.g. silicone, ethylene propylene rubber (EPR), ethylene propylene diene (EPDM), or fluorinated elastomer ("Viton®"), filled with a mineral filler that may be constituted, for example, by alumina, tri-hydrated alumina, titanium oxide, or silica. Particles of tri-hydrated alumina give elastomer material increased ability to withstand dielectric stress, as is known to the person skilled in the art, but they also make the elastomer material opaque, as illustrated by the shading lines. The segment 8 (unshaded) is made by injection molding a second elastomer material having much less filler or a second elastomer material that is not filled so as to remain translucent after molding.

In FIG. 1, rectangle 11 represents diagrammatically an injection mold, while references 12, 13, and 14 designate three inlets for injecting elastomer material. As can be seen in FIG. 1, the injection inlets 12, 13, and 14 are spaced apart along the tube 3. The injection inlet 13 is placed substantially in the middle of the annular segment 8 that forms the observation window 7, while the injection inlets 12 and 14 are disposed substantially in the middles of the respective end segments 9 and 10.

To form the casing 4 around the transparent tube 3, elastomer material filled with alumina particles is injected into the inlets 12 and 14, and simultaneously elastomer material having little or no filler is injected into the inlet 13. By balancing the injection pressures at the inlets 12, 13, and 14, a casing 4 is made having an annular segment 8 that is at least translucent in the middle portion of the casing. Naturally, in order to form the observation window in a selected zone of the casing, the injection inlets 12, 13, and 14 may be offset along the tube 3, and the number of injection inlets may be increased.

The casing 4 is preferably made by being injected around the transparent tube in two distinct stages. Initially, the elastomer material with little or no alumina filler is injected via the inlet 13 in order to form the observation window 7 in a selected zone of the casing 8. Thereafter, once the observation window 7 has been terminated, the elastomer material filled with alumina particles is injected via the inlets 12 and 14 in order to form the respective end segments 9 and 10 of the casing.

The elastomer material of the casing may also be deposited by being wound around the rigid tube instead of by injection.

The system made in this way is gas-tight and presents an annual leakage rate of the order of, or less than, 0.5%.

Figure 2:
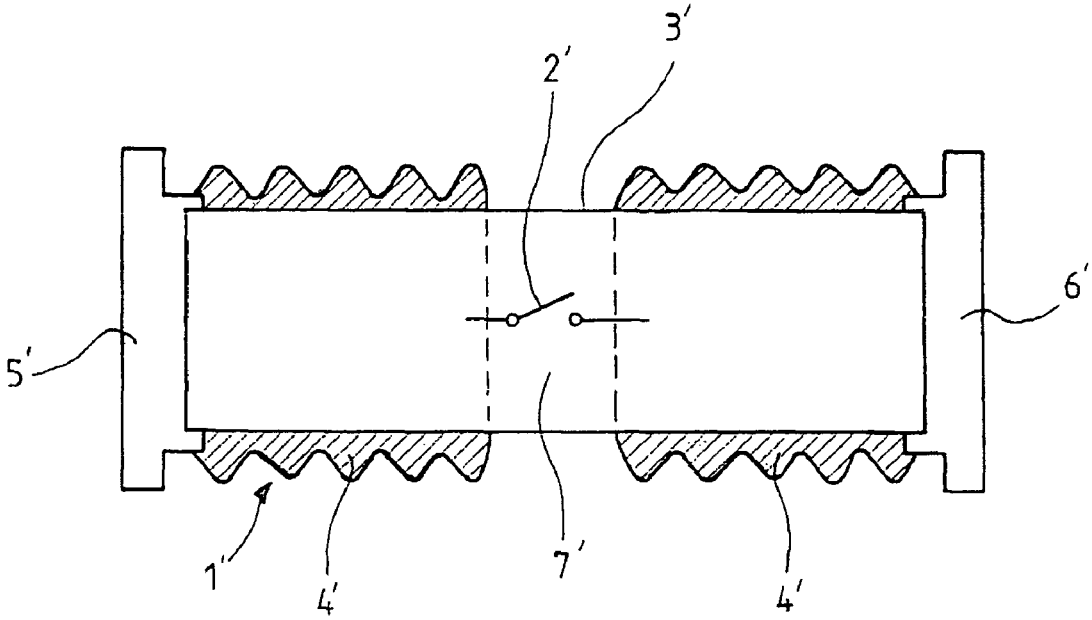
FIG. 2 is a highly diagrammatic view of a second embodiment of an electric switch device of the invention.

In FIG. 2, a high or medium voltage electric switch device 1' of the invention includes a composite insulator formed by a rigid tube 3' surrounded in part by an elastomer casing 41, with a portion that is not surrounded by the casing 4' serving as an observation window 7' for observing the switch contacts 2'.

The rigid tube 3' is made of glass which can be protected on the inside against being attacked by the products of $SF_6$ decomposing. Since glass is good at withstanding abrasion by electric arcing, the glass surface defining the observation window 7' does not need to be surrounded by an elastomer casing.

The casing 4' of elastomer filled with mineral fillers that covers a portion of the rigid tube 3 may be formed either by injection molding or by extrusion and winding. In either case, in order to enable the insulator to perform its electrical insulation function to the best, cohesion between the elastomer 4' and the tube 3' must be very good. For this purpose, prior to depositing the elastomer, it is necessary to deposit on the tube a precursor chemical that is referred to as a bonding primary. This precursor is generally a complex silane compound ($Si—R_4$), e.g. silane epoxy and solvents.

In order to make an observation window, a method is performed which consists in using a mask to prevent the bonding primary being deposited on the window zone, then in depositing elastomer on the entire surface of the rigid tube, and finally in removing the elastomer from the window zone and in cleaning the observation window with alcohol. Bonding of the elastomer on the window zone may optionally be further decreased by depositing on said zone a wetting agent or a grease prior to depositing the elastomer.

Another solution consists in depositing a foam mask in the injection mold, e.g. seeking to prevent elastomer being deposited in the viewing zone.

Thus, in FIG. 2, one of these techniques for forming the casing 4' has been used so as to leave a cylindrical portion of the glass rigid tube 3' uncovered, which portion acts as an observation window 7'. The shape and the size of the observation window 7 can easily be varied.

The system made in this way is gas-tight and presents an annual leakage rate of the order of, or less than, 0.5%.

Figure 3:
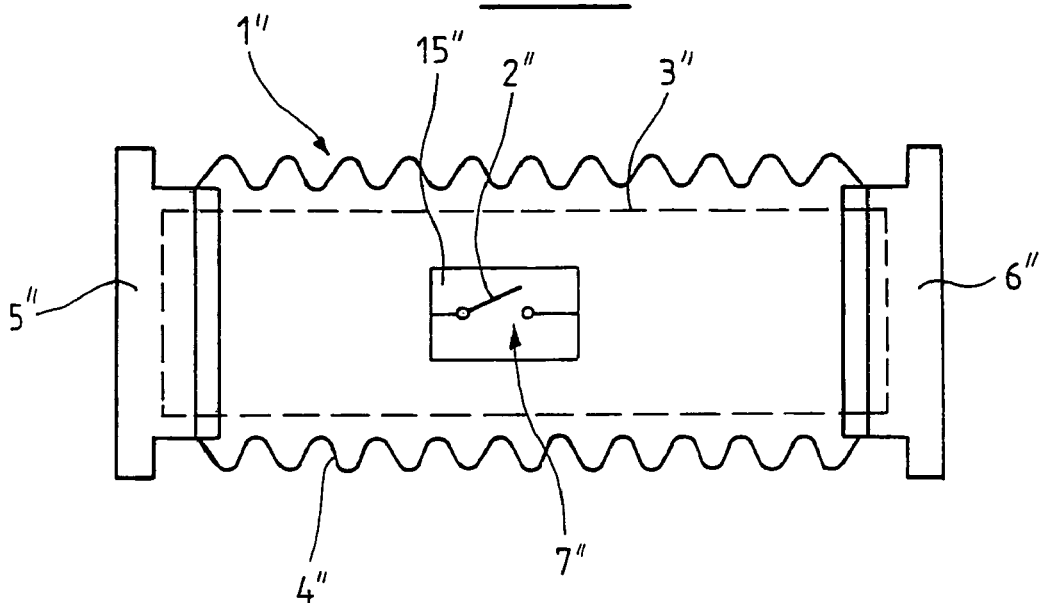
FIG. 3 is a highly diagrammatic view of a third embodiment of an electric switch device of the invention.

In FIG. 3, a high or medium voltage switch device 1" of the invention includes a composite insulator made up of a rigid tube 3" covered in part by a casing 4" of elastomer filled with mineral fillers, the portion of said tube that is not covered by the casing 4" serving as a window 7" for observing the switch contacts 2".

The rigid tube 3" is made either of a translucent composite material, made up of inorganic fibers, optionally braided fibers, inserted in a thermosetting polymer, or of a plastics material that is at least translucent, such as the material described with reference to the rigid tube 3 of FIG. 1. The inside of the tube may optionally be protected against being attacked by the products of $SF_6$ decomposing.

An at least translucent porthole 15" is placed on the wall of the rigid tube 3", said porthole being suitable for filtering ultraviolet radiation and being intended to serve as an observation window. The porthole 15" may be made of glass, optionally doped in order to filter ultraviolet radiation better, or it may be made of a translucent polymer, such as, for example: "Makrolon", "Altuglas", polystyrene, or PVDF, stabilized to withstand ultraviolet radiation or covered in a UV filter. The porthole 15" is stuck onto the rigid tube 3" by means of a transparent epoxy, polyacrylate, or silicone adhesive, possibly after initial machining of the tube 3".

The elastomer casing 4" is then deposited on the rigid tube 3" using the above-described method so as to ensure that the porthole 15" is not covered by the elastomer and can be used as an observation window 7".

The system made in this way is gas-tight and presents an annual leakage rate of the order of, or less than, 0.5%.

Figure 4:
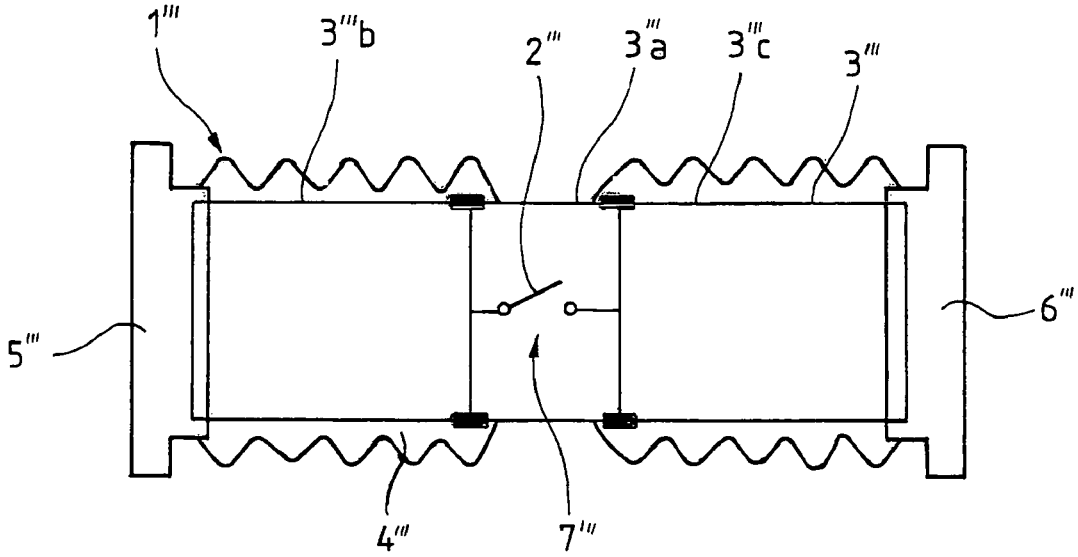
FIG. 4 is a highly diagrammatic view of a fourth embodiment of an electric switch device of the invention.

FIG. 4 shows another embodiment of a high or medium voltage electric switch device 1''' of the invention including a composite insulator formed by a rigid tube 3''' surrounded in part by an elastomer casing 4''', with a portion that is not surrounded by said casing 4''' serving as a window 7''' for observing the switch contacts 2'''.

The rigid tube 3''' is made up of a plurality of portions. For example, an insert tube 3'''*a* of at least translucent material, e.g. glass or a polymer that withstands ultraviolet radiation, is assembled between two tubes 3'''*b* and 3'''*c*, e.g. made of composite material, including inorganic fibers, possibly braided fibers, embedded in a thermosetting polymer such as polyurethane or epoxy. These elements making up the rigid tube 3''' are bonded together by adhesive or by screw fastening and adhesive.

The insert acts as an observation window 7''' and is left uncovered by the elastomer forming the casing, by implementing the method described with reference to FIG. 2. Nevertheless, it is preferable for the elastomer to cover the ends of the insert in order to provide the device with sealing and insulation.

The system made in this way is gas-tight and presents an annual leakage rate of the order of, or less than, 0.5%.

Figure 5:
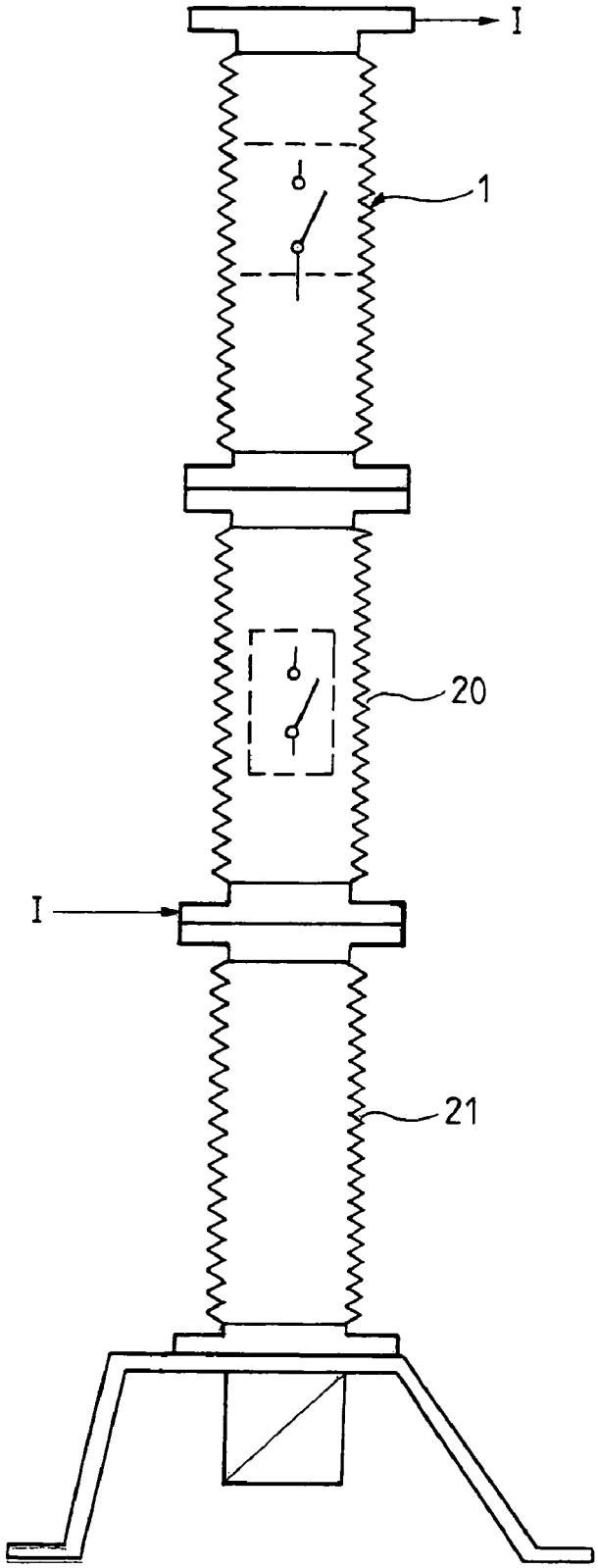
FIG. 5 is a diagrammatic view of a line disconnector in accordance with the invention.

FIG. 5 shows an example of a switch device 1 of the kind shown in FIG. 1 being used in accordance with the invention as a line disconnector, being connected in series with a circuit breaker 20 within a porcelain casing, for example, the assembly comprising the electric switch device 1 used as a disconnector plus the circuit breaker 20 being mounted on the ground on a porcelain supporting insulator 21. In such an assembly, current I is initially interrupted by the circuit breaker 20, with the electric switch device 1 that is used as a disconnector, itself being opened subsequently. Consequently, the transparent tube 3 of the disconnector is generally not subjected to the effects of electric arcing.

The system made in this way is gas-tight and presents an annual leakage rate of the order of, or less than, 0.5%.

Figure 6:
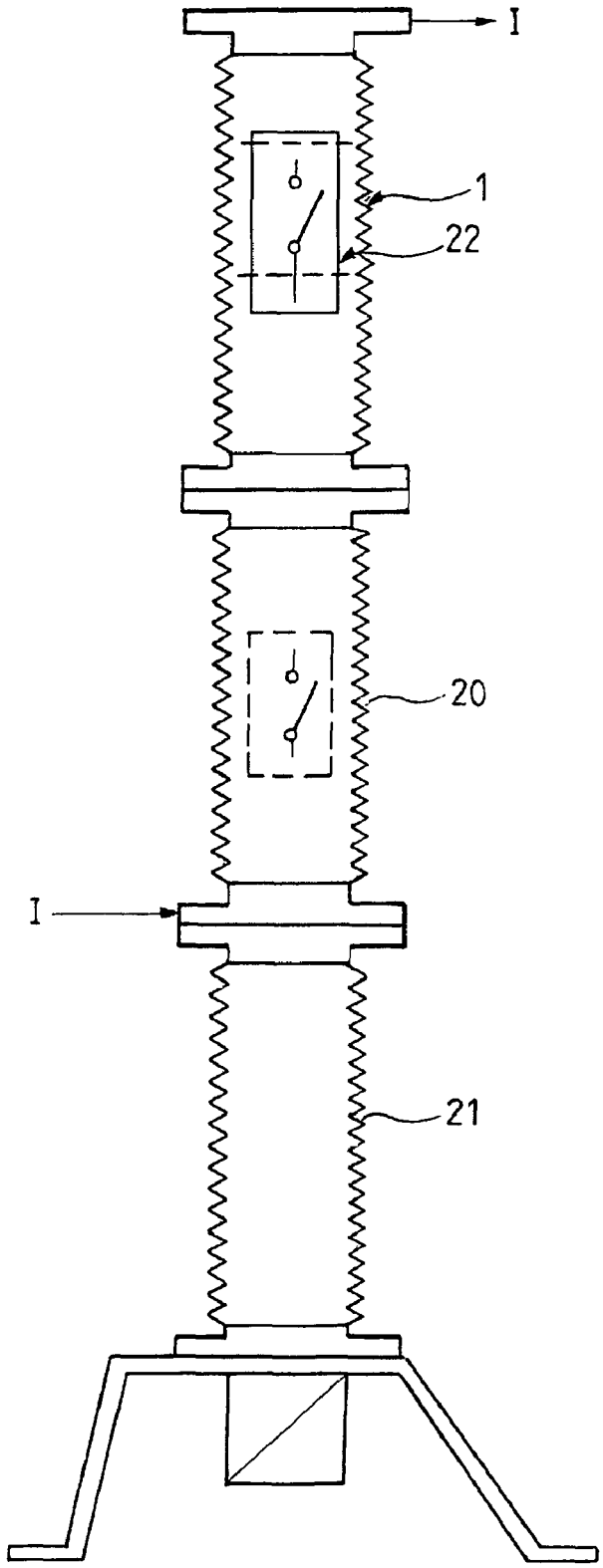
FIG. 6 is a highly diagrammatic view of a line disconnector in accordance with the invention, comprising a vacuum bottle with a viewing window.

FIG. 6 shows an example of using a line disconnector in accordance with the invention and of the kind referenced 1 in FIG. 1. It comprises a vacuum bottle 22 with a viewing window that is mounted in series with a circuit breaker 20 within a porcelain casing, for example. The electric switch device 1 as a whole is used as a disconnector, and the circuit breaker 20 is mounted on the ground by a supporting insulator 21 made of porcelain. In such a configuration, the current I is initially broken by the circuit breaker 20, with the electric switch device 1 that is used as a disconnector being opened subsequently. Consequently, the transparent tube 3 of the disconnector is generally not subjected to the effects of electric arcs.

The system made in this way is gas-tight and presents an annual leakage rate of the order of, or less than, 0.5%.

A disconnector in accordance with the invention may also be installed in a V-configuration with one circuit breaker, or in a U-configuration, the base of the U being constituted by the circuit breaker and with the two limbs of the U-shape each being constituted by a disconnector in accordance with the invention.

An electric switch device of the invention presents the advantage of being simple to make and of having a system enabling the position of the switch contacts to be identified directly. An electric switch device of the invention could consist in a circuit breaker insofar as the plastics material of the tube is adapted to being attacked by electric arcing and is strong enough to withstand pressures in excess of 6 bars.

The invention claimed is:

1. A gas-tight, high or medium voltage electric switch device comprising an enclosure containing switch contacts capable of occupying an open position and a closed position, and a window for observing the open or closed position of the switch contacts from outside the enclosure, the enclosure being a composite insulator formed by a rigid tube surrounded by an elastomer casing whose outside surface defines a succession of annular fins, the casing being constituted in a single part molded on the rigid tube, the rigid tube being made of a plastics material that is at least translucent, wherein a segment of the casing surrounding the switch contacts is made of an elastomer material that is at least translucent, said segment defining said observation window, the translucent segment of the casing being made by injection molding a first elastomer material and being interposed between two end segments of the casing which are made by injection molding a second elastomer material having a greater fill of mineral fillers than the first elastomer material, the portions of the device that come into contact with solar radiation withstanding ultraviolet radiation, the enclosure being filled with a dielectric gas which is at a pressure of 2 bars to 3 bars.

2. The device of claim 1, in which the at least translucent plastics material is polymethyl methacrylate, polycarbonate, polystyrene, or polyvinylidene fluoride.

3. The device of claim 1, in which the elastomer material is silicone, ethylene propylene rubber, or fluorinated elastomer.

4. The device of claim 1, in which the rigid tube is protected on the inside by a deposit of transparent material that is chemically inert against attack by the products of $SF_6$ decomposing.

5. The device of claim 1, wherein the rigid tube is protected on the inside by a deposit of polytetrafluoroethylene or other fluorinated polymers.

* * * * *